United States Patent [19]

Barriac

[11] Patent Number: 4,807,770

[45] Date of Patent: Feb. 28, 1989

[54] COMPOSITE, TAMPER EVIDENT, VACUUM INDICATING CLOSURE AND CONTAINER

[75] Inventor: Jacques J. Barriac, Montgomery, Pa.

[73] Assignee: Owens-Illinois Closure Inc., Toledo, Ohio

[21] Appl. No.: 160,477

[22] Filed: Feb. 25, 1988

Related U.S. Application Data

[63] Continuation-in-part of Ser. No. 29,030, Mar. 23, 1987, abandoned.

[51] Int. Cl.[4] ..... B65D 41/34

[52] U.S. Cl. ..... 215/252; 215/271; 215/276

[58] Field of Search ..... 215/252, 276, 230, 271

[56] References Cited

U.S. PATENT DOCUMENTS 4,093,094 6/1978 Smalley et al. ..... 215/276

4,694,970 9/1987 Hayes ..... 215/252

*Primary Examiner*—Donald F. Norton

[57] ABSTRACT

A tamper evident, vacuum indicating closure for a container for the packaging of a vacuum-packed product, the closure being of two-piece construction and having a metal lid portion which is retained in sealing engagement with the rim of a container by a plastic ring portion. The metal lid portion has a vacuum indicating button centered therein. The ring portion of the closure has a series of spaced apart flanges projecting radially inwardly at the top thereof to urge the top of a curl at the outside of the lid against the rim of the container, the ring portion of the container further having a series of spaced apart flexible tabs to engage the underside of the curl of the lid so that the lid portion and the ring portion can be conveniently handled in unison, and to positively remove the lid from the finish of the container at the time of the removal of the closure from the container. The ring portion of the closure also has an annular skirt, and the bottom of the annular skirt of the ring portion of the closure has a tamper evident band attached thereto by frangible bridges, and the tamper evident band has a series of spaced apart flexible tabs which extend inwardly and upwardly therefrom to engage an annular bead on the finish of the container.

49 Claims, 2 Drawing Sheets

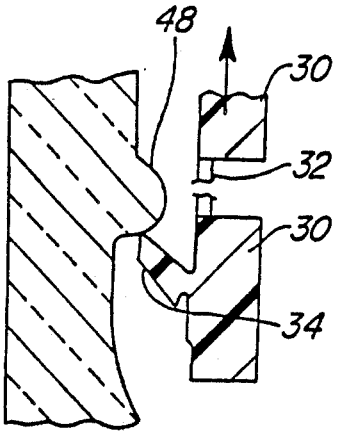
Fig-4
Fig-5
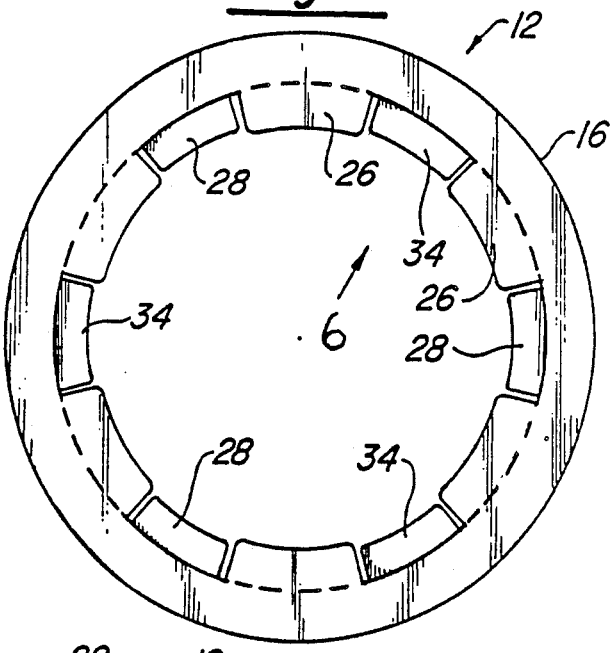
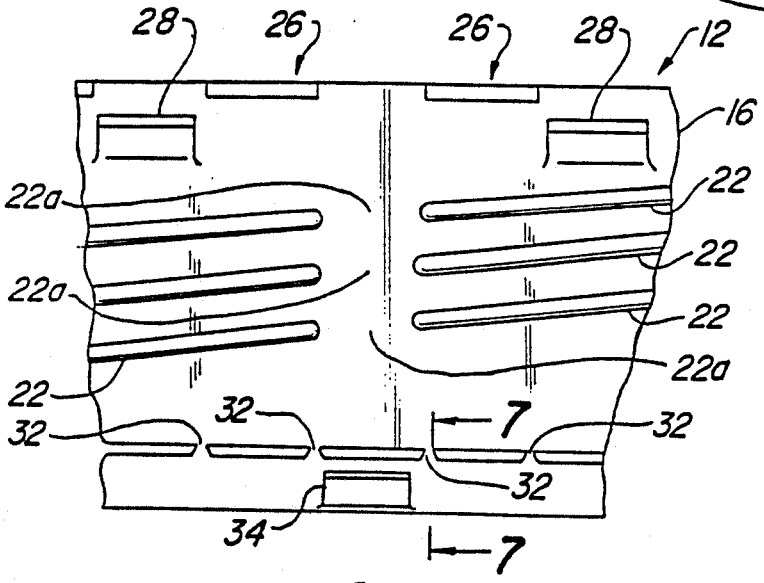
Fig-6
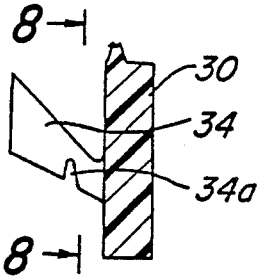
Fig-7
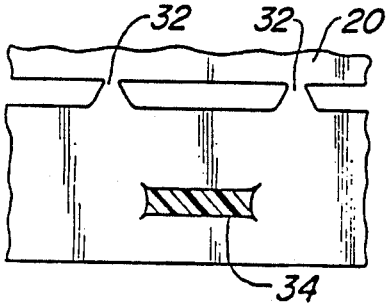
Fig-8
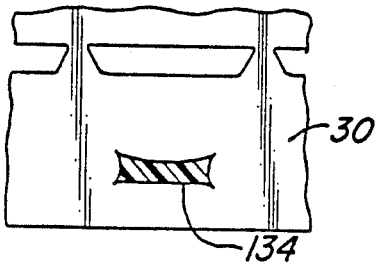
Fig-9
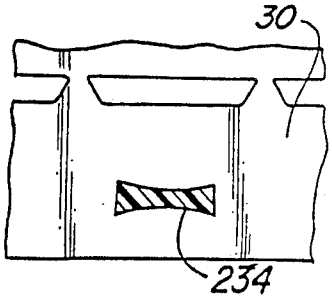
Fig-10

COMPOSITE, TAMPER EVIDENT, VACUUM INDICATING CLOSURE AND CONTAINER

CROSS-REFERENCE TO RELATED APPLICATION

This application is a continuation-in-part of my copending application Ser. No. 029,030, filed on Mar. 23, 1987, now abandoned.

BACKGROUND OF THE INVENTION

1. Field of the Invention

This invention relates to a composite closure for a container for the packaging of a product under at least partial vacuum. The composite closure includes a metal lid that has a portion whose position is altered by a loss of vacuum within the container to give a visual indication of such loss of vacuum, and a plastic ring to secure the metal lid to the rim of the container. The plastic ring has a tamper indicating band at its lowermost marginal edge, and this tamper indicating band must be irreparably and visibly damaged upon the first removal or attempted removal of the closure from the container to provide a visible indication of any prior attempt to open the container.

2. Description of the Prior Art

Many food products which are packaged in glass jars are packaged under a partial vacuum to prevent spoilage or to preserve flavor, and it is important that the closure for such a container be able to seal the container properly to maintain the vacuum in the container until the first opening thereof. It has also been recognized that it is desirable for a closure for a container for a vacuum-packed product to incorporate means which will indicate the presence or absence of the desired degree of vacuum, to ensure the freshness and wholesomeness of the packaged product when the package is purchased and when it is opened, and the prior art is familiar with metal closures which incorporate such a feature. For example, U.S. Pat. No. 3,152,711 (G. V. Mumford et al.), which is assigned to the assignee of this application, discloses a one-piece metallic closure in which the top panel of the closure incorporates a domed central portion, which domed central portion is deflected downwardly by the presence of a suitable degree of partial vacuum in the associated container. Because of the inherent elasticity of the metal of the closure, the deflected domed central portion will return to its normal position upon the release of the vacuum and the resulting repressurization of the container, thereby providing an indication of such release of container vacuum which is detectable visually or by various types of electro-mechanical or electro-optical inspection equipment. U.S. Pat. Nos. 3,062,396 (G. J. Foss et al.), 3,160,302 (G. F. Chaplin), and 4,533,059 (W. J. Kapolas et al.) also disclose one-piece metallic vacuum indicating closures that operate in a similar manner, and U.S. Pat. No. 3,836,033 (A. Podesta) discloses a two-piece vacuum indicating closure having a metallic closure panel and a separate metallic closure panel retention skirt that otherwise also operates in a similar manner.

U.S. Pat. Nos. 4,093,094 (N. J. Smalley et al.) and 4,121,729 (C. W. Husum), which are assigned to the assignee of this application, disclose two piece vacuum indicating closures that are useful in a home canning system. According to the teachings of these references, certain advantages are obtained in a vacuum indicating closure when at least the skirt portion thereof is formed from a thermoplastic material. However, the closure systems of the aforesaid U.S. Pat. Nos. 4,093,094 and 4,121,729 require separate handling of the metal lid and plastic ring components thereof, since the closure systems of such references do not incorporate means to positively interlock the metal lid and the plastic ring, and, thus, the closure systems of the aforesaid U.S. Pat. Nos. 4,093,094 and 4,121,729 are not suitable for use in a packaging plant where it is necessary to mechanically apply closures to containers at a high rate of speed in order to be able to meet the cost constraints that apply to any such industrial operation. Further, while U.S. Pat. No. 4,694,970 (T. H. Hayes) shows a composite closure with a metal lid and a plastic lid engaging ring in which the ring is provided with a disengageable tamper indicating band, this closure is not disclosed as having vacuum indicating characteristics, and the vacuum indicating closures of the various prior art patents heretofore identified do not incorporate separate tamper-indicating design features. These closures rely upon the change in the position of the domed central portion of the closure metal lid, which occurs upon the loss of vacuum in the associated container, to provide evidence of the prior opening of the container. However, the position of the domed central portion of the metal lid of a vacuum indicating closure is easily reversible and its position is not as visually detectable as is the irreparable damage that is sustained by many molded plastic closures of the tamper-indicating type, and, in any event, the domed central portion of the metal lid of the closure will change its position upon a mere loss of vacuum in the associated container resulting from a sealing irregularly between the closure and the container, and does not, necessarily, indicate that the package in question has experienced a tampering attempt. U.S. Pat. No. 3,460,701 (J. C. Powalowski et al.) does disclose a two-piece, tamper-evident closure that includes a metal lid and a plastic ring to maintain such metal lid in contact with the associated container, but the two-piece closure of this reference is of the snap-on type, and, thus, requires the use of a cumbersome lifting ring in the top of the closure retaining ring to remove the two-piece closure from the container, the deformation of the lifting ring during the removal of the closure resulting in the tamper-indicating characteristics of the product.

SUMMARY OF THE INVENTION

According to the present invention, there is provided a two-piece or composite closure for a container for a vacuum-packed product, which closure is suitable for mechanical application on a high speed basis in a food or beverage packaging plant. The closure of the present invention incorporates a metal lid and a plastic ring which mechanically engages and retains the metal lid and which incorporates a helical thread on its inside surface by which it can secure itself and the associated metal lid to the helical thread of a container finish. The metal lid of the closure, preferably, has a centrally located, deformable, vacuum indicating button which will be drawn from its normal position into the head space of the associated container by the presence of a vacuum therein, and which will return to its original normal position upon the loss of vacuum in the container head space. The metal lid is provided with an outer annular portion in the form of a curled rim or wire, and the plastic ring is provided with radially inwardly extending spaced apart flanges at the top thereof. The underside of each of the spaced apart flanges of the plastic collar engages the top of the outer annular portion of the metal lid to securely retain the metal lid in sealing engagement with the rim of the associated container, when the plastic collar has been securely affixed to the finish of the container. Further, the plastic collar is provided with a circumferential series of spaced apart tabs that project inwardly and upwardly from a skirt portion of the plastic collar. This series of tabs securely engages the bottom of the outer annular portion of the metal lid, to help maintain the assembled relationship between the metal lid and the plastic collar and to help to remove the metal lid from the container upon the unscrewing of the plastic collar from the finish of the container. Further yet, the plastic ring is provided with a lower marginal portion which is separated from the portion thereabove by frangible bridges, and such lower marginal portion is provided with a second circumferential series of inwardly and upwardly extending tabs, which tabs engage the underside of a circumferential bead on the finish of the container to cause the frangible bridges to rupture upon the first removal or attempted removal of the plastic ring from the finish of the container, thereby resulting in the physical separation of the lower marginal portion of the plastic ring from the portion thereabove and providing a visible indication of such prior removal or attempted removal of the plastic ring from the container finish. Preferably, the thread on the inside of the plastic ring is interrupted or discontinuous to provide for axial access of molding tooling to the inwardly and upwardly directed tabs of the tamper-indicating band of the plastic ring. For example, the helical thread of the plastic ring can be in the form of a single start helical thread with interruptions or discontinuities along such helical thread, it can be in the form of a multiple start helical thread with spaces between the individual helical threads, or it can be in the form of deformable, spaced-apart ribs, in which case the plastic ring can be applied to a helically threaded container by a push-on action, but can only be removed from such container by a twist-off action due to the deformation of each of such ribs which results from the engagement of such ribs with the thread on the container. U.S. Pat. No. 3,371,813 (R. C. Owen et al.) and British Patent Specification No. 635,262 (E. T. Webb) describe various types of push-on, twist-off closures.

Accordingly, it is an object of the present invention to provide a composite or two-piece closure for a container for the packaging of a product under vacuum in which at least the skirt portion of the closure is formed from a thermoplastic material, and which includes a tamper-indicating band at the lower marginal portion of such skirt portion of the closure which is subjected to irreparable damage upon the first removal or attempted removal of the closure from the container.

It is a further object of the present invention to provide a two-piece closure for a container for the packaging of a product under vacuum in which such closure includes separate top panel and skirt elements which are mechanically interengageable with one another, to facilitate the rapid and reliable mechanical handling of such closure elements in a food or beverage packaging plant.

It is also an object of the present invention to provide an improved package for the packaging of a food or beverage product under vacuum, which package includes a novel and improved two-piece closure that is made up of separate top panel and skirt elements, the top panel element being formed of metal and including a movable vacuum indicating central panel portion to provide a positive and reliable indication of the loss of vacuum in such package, the skirt element being part of a molded plastic ring which secures such metal top panel to the container and which includes a tamper-indicating feature to provide a visible indication of the first removal or attempted removal of such two-piece closure from the container.

For a further understanding of the present invention and the objects thereof, attention is directed to the drawing and the brief description thereof, to the detailed description of the preferred embodiment and to the appended claims.

BRIEF DESCRIPTION OF THE DRAWING

FIG. 4 is a view similar to FIG. 3 showing a step in the removal of the composite closure of FIG. 1 from the container of such Figure;

FIG. 5 is a top plan view of the composite closure shown in FIG. 1;

FIG. 6 is a fragmentary elevational developed view of the interior of the composite closure of FIGS. 1 and 5, taken on line 6 of FIG. 5;

FIG. 7 is fragmentary sectional view taken on line 7—7 of FIG. 6;

FIG. 8 is a fragmentary sectional view taken on line 8—8 of FIG. 7;

FIG. 9 is a view similar to FIG. 8 illustrating an alternative embodiment of the present invention; and FIG. 10 is a view similar to FIGS. 8 and 9 illustrating another alternative embodiment of the present invention.

DETAILED DESCRIPTION OF THE PREFERRED EMBODIMENT

Figure 1:
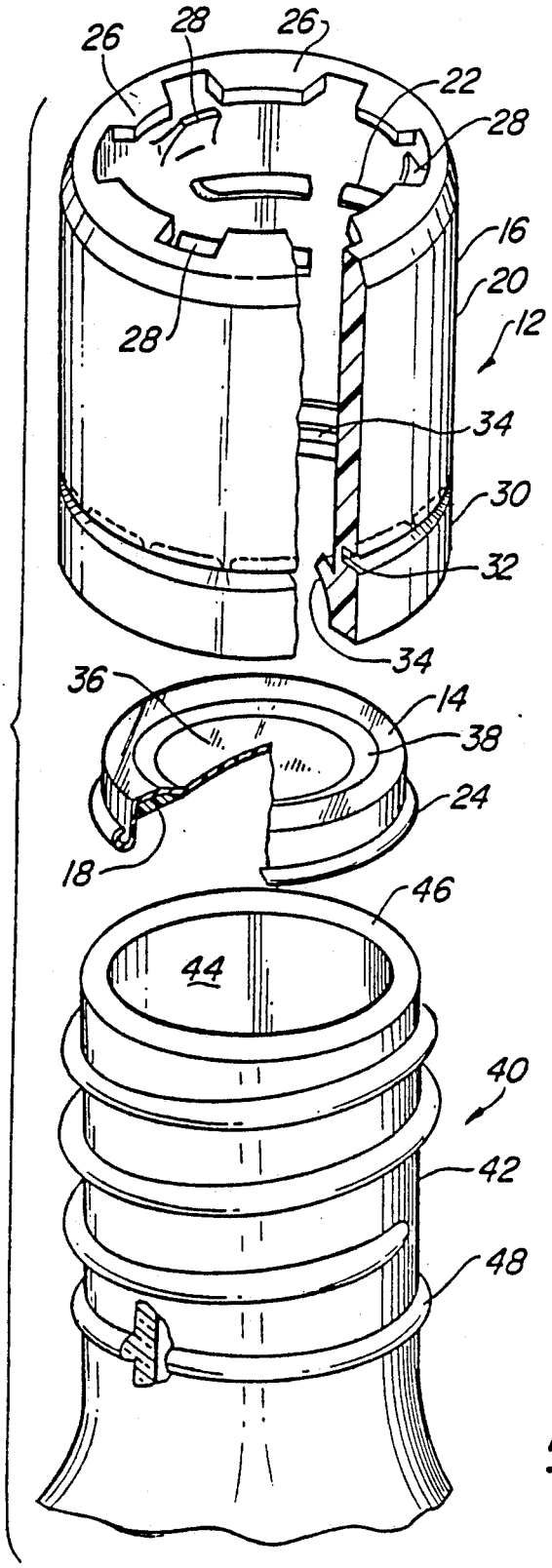
FIG. 1 is an exploded perspective view, partly in section, of a container, shown fragmentarily, and a composite closure therefor according to the present invention.
Figure 2:
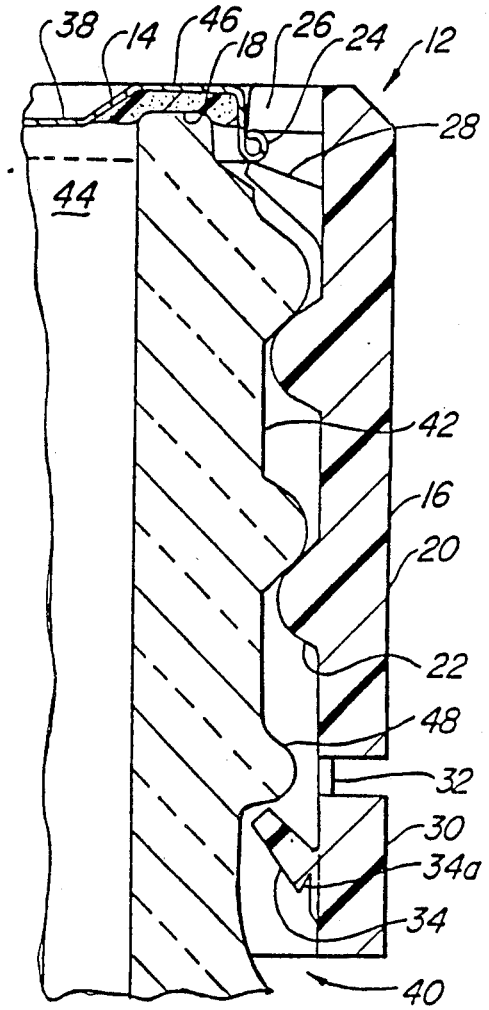
FIG. 2 is a fragmentary elevational view, in section and at an enlarged scale, showing the composite closure of FIG. 1 in attached relationship to the container of such Figure.

The closure according to the present invention is indicated generally by reference numeral 12 in the drawing. The closure 12, as is shown in FIGS. 1 and 2, is adapted to be applied in closing relationship to a container, indicated generally by reference numeral 40, which is of a type that is suitable for the packaging of a food product or other product of a type which is advantageously packaged under sub-atmospheric pressure or vacuum conditions to prevent spoilage or preserve flavor. Typically, the container 40 may constitute a conventional widemouth glass container, for example, the type of container which is used in the packaging of salted peanuts, jam, jelly, pickles or other food items, a container which is usually provided with a finish diameter (the "T" dimension, or the nominal outside diameter of the container thread) of at least 38 millimeters. In any case, the container 40 is provided with a threaded neck or finish portion 42 which surrounds an open mouth 44 of the container 40, the mouth 44 terminating in a rim 46.

The closure 12 of the present invention is made up of a metallic lid portion 14 and a plastic, lid-retaining ring portion 16 which secures the lid portion 14 to the rim 46 of the container 40, the underside of the lid portion 14 having a sealing or gasket material 18 applied thereto in a continuous or annular pattern to facilitate the formation of a seal between the closure 12 and the rim 46 of the container 40, to thereby help maintain the desired degree of vacuum in the container 40. The sealing material 18 may, for example, be made up of a conventional ring of a plastisol sealing compound, as is known in the art. The lid portion 14 of the closure, illustratively, is formed from tin-plated steel sheet in a stamping operation.

The lid-retaining ring portion 16 of the closure 12, preferably, is molded in a single piece from a suitable semi-rigid thermoplastic material. In the illustrated embodiment the ring portion 16 is made by a process in which it is stripped from the associated mold tooling. Thus, the material must have sufficient flexibility to be strippable from mold tooling. Suitable materials include high density polyethylene, polypropylene and flexible polyesters and copolyesters. In cases where the lid-retaining ring portion 16 is expected to encounter high processing temperatures during the processing of the filled and capped container 40, it is preferably formed from reinforced polypropylene or similar material. In any case, the lid retaining ring portion 16 of the closure 12 has an annular skirt 20 which is adapted to surround and removably engage the finish 42 of the container 40. The annular skirt 20 is provided with thread means projecting radially inwardly therefrom, preferably, for reasons which will subsequently be described, an interrupted helically extending thread 22 for engaging the helically threaded finish 42 of the container 40 to permit the closure 12 to be applied to the container 40 by a screwing action and removed from the container by an unscrewing action.

The lid portion 14 of the closure 12 is provided with an outer annular portion 24, preferably in the form of a curl, to add rigidity to the lid portion and to present a smooth outer edge for safe grasping by a user. The lid portion 14 and the lid-retaining ring portion 16 are mechanically interengaged for handling as a unit by providing the lid-retaining ring portion with means for engaging the curl 24 of the lid portion 14, preferably both on the top and the bottom of such curl 24. Thus, the curl 24 of the lid portion 14 of the closure 12 is engaged by providing the lid-retaining ring portion 16 of the closure 12 with a circumferential series of spaced apart flanges 26 extending radially inwardly from the annular skirt 20 of the lid-retaining ring portion 16, and, preferably, from locations at the top of the annular skirt 20. Further, the annular skirt 20 of the lid-retaining ring portion 16 of the closure 12 is provided with a circumferential series of spaced apart flexible tabs 28 which extend inwardly and upwardly from the inside of the annular skirt 20 toward the circumferential series of spaced apart flanges 26, the flanges 26 being adapted to engage the top of the curl 24 of the lid portion 14 of the closure, and the flexible tabs 28 being adapted to engage the bottom of the curl 24. Preferably, the flexible tabs 28 are circumferentially offset with respect to the flanges 26 to permit access to the flexible tabs 28 by the portions of the molding tooling used to mold such flexible tabs, through the spaces between the flanges 26. By virtue of the flexibility and the oblique orientation of the flexible tabs 28, the lid portion 14 may be assembled into the lid-retaining ring portion 16 by moving it upwardly through the ring portion 16, an action which will deflect the flexible tabs 28 until the curl 24 of the lid portion 14 passes thereover, at which time each of the flexible tabs will spring back to its normal orientation as shown in FIGS. 1 and 2, where the flexible tabs 28 cooperate with the flanges 26 to securely interengage the lid portion 14 and the lid retaining ring portion 16. As shown, the curl 24 of the lid portion 14 of the closure 12 is positioned below the level of the rim 46, so that the tops of the flanges 26 of the lid retaining portion 16 of the closure 12 are aligned with the rim 46 for an attractive appearance or for good stacking characteristics. Further, the flexible tabs 28 will assist in the disengagement of the lid portion 14 from the container 40 upon the unscrewing of the closure 12 from the container 40.

Figure 3:
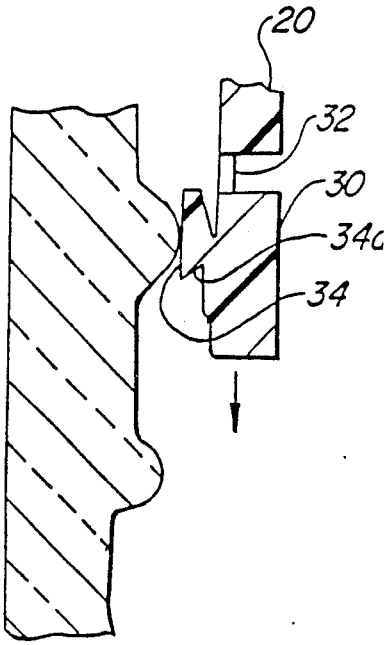
FIG. 3 is a fragmentary elevational view, in section, showing a step in the attachment of the composite closure of FIG. 1 to the container of such Figure.

The package which includes the container 40 and the closure 12 may be used in the packing of products which are sold through retail outlets for consumption by consumers, and such packages, desirably, are provided with an element which must be irreparably and visibly damaged upon the first removal or attempted removal of the closure 12 from the container 40 to provide a visible indication of any prior attempt to open the container, to at least put consumers on notice of any attempt to tamper with the package or its contents. Thus, the annular skirt 20 of the lid retaining portion 16 of the closure 12 is provided with a tamper-indicating band 30 which constitutes the lowermost marginal portion of the annular skirt 20. The tamper-indicating band 30, which is attached to the portion of the annular skirt 20 thereabove by a circumferential series of spaced apart frangible bridges 32, is irremovably attached to the finish 42 of the container 40 by providing the finish 42 of the container 40 with an annular bead 48, which is frequently referred to as a transfer bead, and by providing the tamper-indicating band 30 of the lid-retaining ring portion 16 of the closure 12 with a circumferential series of flexible tabs 34 which extend inwardly and upwardly from the interior of the tamper-indicating band 30 to engage the underside of the annular bead 48 of the container 40 when the closure 12 is securely affixed to the container 40. Thus, upon the first removal or attempted removal of the closure 12 from the finish 42 of the container 40, the tamper-indicating band 30 is prevented from being removed with the remaining portions of the closure 12 by the interference between the flexible tabs 34 and the annular bead 48 of the container 40, which causes fracturing of the frangible bridges 32 upon the further removal of the closure 12 from the container 40, and, thereby, a separation of the tamper-indicating band 30 from the annular skirt 20 of the lid-retaining ring portion 16. As is shown in FIG. 3, each of the flexible tabs 34 is provided with a notch **34*a* in its underside to permit it to be deflected by the helical thread on the finish 42 of the container 40, and then by the annular bead 48 of the finish 42, to permit the application of the closure 12 to the container 40, but which, as is shown in FIG. 4, will remain in interfering contact with the annular bead 48 of the container 40 upon the removal of the closure 12 from the container 40**.

In the manufacture of the lid-retaining ring portion 16 from a thermoplastic material by a molding process, it is desireable to be able to withdraw the portions of the molding tooling that are used to form the flexible tabs 34 upwardly through the interior of the lid-retaining ring portion 16, and past the helically extending thread 22 thereof. Thus, as previously explained, the helically extending thread 22 is interrupted with the interruptions or spaces between the segments thereof being identified by reference numeral 22a in FIG. 6.

The lid portion 14 of the closure 12 is preferably of the vacuum indicating type, and vacuum indicating characteristics can be imparted to the lid portion by providing it with a generally centrally located vacuum indicating button 36 and an intermediate annular portion 38 to connect the vacuum indicating button 36 with the outer annular portion 24. Thus, when the closure 12 is in its closing position on the finish 42 of the container 40, the sub-atmospheric or negative pressure in the unfilled portion of the container 40 above the top surface of the product therein, which is commonly referred to as the container "headspace", will draw the vacuum indicating button 36 downwardly so that the plane of its top surface will be below the outer annular portion 24, with the relative movement of the vacuum indicating button 36 relative to the outer annular portion 24 being accommodated by deflection of the intermediate annular portion 38. If the vacuum in the headspace of the container 40 should be broken, for example, by an opening or a partial opening of the closure 12 or by a seal failure due to an irregularity in the rim 46 of the container 40, the headspace will draw in air from its surroundings and will become repressurized. This increase in pressure on the underside of the vacuum indicating button 36, together with residual stress in the lid portion 14 of the closure 12 by virtue of the fact that it is formed from metal, a highly elastic material, will cause the vacuum indicating button 36 of the lid portion 14 to move or pop upwardly, where the plane of the top surface of the vacuum indicating button 36 will be at a noticeably higher elevation, for example, above the elevation of the top surface of the outer annular portion 24. Through proper warnings or instructions on the closure 12 or the container 40, or in any associated printed materials, a consumer or retail store employee can be advised of any undesireable characteristics which are associated with the use of a package which does not contain the desired degree of vacuum at the time of the first opening, and can be instructed how to readily determine the presence or absence of such vacuum by the position of the vacuum indicating button 36. Additionally, this feature can be utilized as a basis for continuous inspection of many filled containers in a packaging plant where various types of electro-optical or electro-mechanical gaging equipment can be utilized to automatically read the position of the vacuum indicating button 36, and to discard any filled container 40 whose closure 12 does not have such vacuum indicating button 36 in an acceptable position.

As is illustrated in FIG. 8, in the preferred embodiment of the present invention, each of the flexible tabs 34 is of substantially uniform thickness from side to side, especially at the juncture of the tab 34 with the tamper-indicating band 30, that is, with its top and bottom surfaces extending in horizontal planes. However, if needed to increase the rigidity of the tab against deflection upon the removal of the closure 12 from the finish 42 of the container 40, an alternative tab construction 134 may be employed, as is shown in FIG. 9, in which one of the surfaces, shown as the top surface, is curved, to provide for an increased thickness at each end, and if further rigidity is needed, as is shown in FIG. 10, an alternative tab construction 234 may be employed in which both the top and bottom sides of the tab are curved to provide further increases in the thickness of the ends of the tab at the juncture with the tamper-indicating band 30.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims.

What is claimed is:

1. A closure for engaging the rim of a helically threaded finish on a container, said closure comprising, in combination:

a lid having an outer annular portion, said outer annular portion having a top and a bottom, said lid being adapted to span and engage the rim of the finish of the container; and a lid retaining ring, said lid retaining ring comprising;

an annular skirt having an upper portion and a lower portion, said annular skirt being adapted to surround the helically threaded finish on the container, lid engaging means projecting radially inwardly from said annular skirt at a location adjacent said upper portion of said annular skirt for engaging said top and said bottom of said outer annular portion of said lid to frictionally retain said lid and said lid retaining ring in position relative to one another, said lid engaging means comprising a circumferential series of spaced apart flanges for engaging said top of said outer annular portion of said lid, and thread engaging means projecting radially inwardly from said annular skirt at a location between said upper portion and said lower portion for engaging the helically threaded finish of the container and for permitting said closure to be removed from the container by an unscrewing action.

2. A closure according to claim 1 wherein said lid retaining ring is molded in a single piece from a thermoplastic material.

3. A closure according to claim 2 wherein said thermoplastic material is a material whose primary ingredient is selected from the group consisting of high density polyethylene, polypropylene, modifications of polypropylene, and flexible polyesters and copolyesters.

4. A closure according to claim 2 wherein said lid retaining ring is molded by a process selected from the group consisting of injection molding processes and compression molding processes.

5. A closure according to claim 2 and further comprising tamper indicating means, said tamper indicating means comprising annular band means positioned below said annular skirt and frangible bridge means connecting said annular band means to said annular skirt.

6. A closure according to claim 1 wherein said lid retaining means further comprises a circumferential series of spaced apart flexible tabs, each of said flexible tabs extending inwardly and upwardly from said annular skirt and engaging said bottom of said outer annular portion of said lid.

7. A closure according to claim 6 wherein the flexible tabs in said circumferential series of spaced apart flexible tabs are circumferentially offset with respect to the flanges in said circumferential series of spaced apart flanges.

8. A closure according to claim 1 wherein said lid comprises a disc that is formed from a metallic sheet and wherein said outer annular portion of said lid comprises a curled edge of said disc.

9. A closure according to claim 8 wherein said disc has a top side and a bottom side, and wherein said lid further comprises a ring of an organic sealing compound applied to said bottom side of said disc, said ring of an organic sealing compound being adapted to sealingly engage the rim of the finish of the container in a continuous pattern.

10. A closure according to claim 1 wherein said lid retaining further comprises tamper indicating means adjacent said lower position said annular skirt, said tamper indicating means comprising means engageable with the finish of the container and being separable from said lower portion of said annular skirt upon the removal of said closure from the container to provide a visible indication of said removal of said closure from the container.

11. A vacuum indicating closure for sealingly engaging the rim of a helically threaded finish on a container containing a vacuum-packed product, said closure comprising, in combination:

a lid, said lid being formed from a metal sheet and being adapted to span and sealingly engage the rim of the finish of the container, said lid comprising;

an outer annular portion with a top and a bottom, a generally centrally located vacuum indicating button, and an inner annular portion surrounding said vacuum indicating button and being surrounded by said outer annular portion, said vacuum indicating button being movable relative to said outer portion, under the influence of pressure conditions in the container, from a first position which indicates that sub-atmospheric pressure conditions do not exist within the container to a second position which indicates that sub-atmospheric pressure condition do exist within the container, and a lid retaining ring, said lid retaining ring comprising;

an annular skirt having an upper portion and a lower portion, said annular skirt being adapted to surround the helically threaded finish on the container, lid engaging means projecting radially inwardly from said annular skirt at a location adjacent said upper portion of said annular skirt for engaging said top and said bottom of said outer annular portion of said lid to frictionally retain said lid and said lid retaining ring in position relative to one another, said lid engaging means comprising a circumferential series of spaced apart flanges for engaging said top of said outer annular portion of said lid, and thread engaging means projecting radially inwardly from said annular skirt at a location between said upper portion and said lower portion for engaging the helically threaded finish of the container and for permitting said closure to be removed from the container by an unscrewing action.

12. A vacuum indicating closure according to claim 11 wherein said lid retaining ring is molded in a single piece from a thermoplastic material.

13. A vacuum indicating closure according to claim 12 wherein said thermoplastic material is a material whose primary ingredient is selected from the group consisting of high density polyethylene, polypropylene, modifications of polypropylene and flexible polyesters and copolyesters.

14. A vacuum indicating closure according to claim 12 wherein said lid retaining ring is molded by a process selected from the group consisting of injection molding processes and compression molding processes.

15. A vacuum indicating closure according to claim 12 wherein said lid retaining ring further comprises tamper indicating means adjacent said lower portion of said annular skirt, said tamper indicating means comprising means engageable with the finish of the container and being separable from said lower portion of said annular skirt upon the removal of said closure from the container to provide a visible indication of said removal of said closure from the container.

16. A vacuum indicating closure according to claim 15 wherein said tamper-indicating means further comprises annular band means positioned below said annular skirt and frangible bridge means connecting said annular band means to said annular skirt.

17. A vacuum indicating closure according to claim 11 wherein said lid retaining means further comprises a circumferential series of spaced apart flexible tabs, each of said flexible tabs extending inwardly and upwardly from said annular skirt, extending obliquely from said annular skirt toward said circumferential series of spaced apart flanges and engaging said bottom of said outer annular portion of said lid.

18. A vacuum indicating closure according to claim 17 wherein the flexible tabs in said circumferential series of flexible tabs are circumferentially offset with respect to the flanges in said circumferential series of spaced apart flanges.

19. A vacuum indicating closure according to claim 18 wherein said outer annular portion of said lid comprises a curled edge of said metal sheet.

20. A vacuum indicating closure according to claim 19 wherein said lid has a top side and a bottom side, and wherein said lid further comprises a ring of an organic sealing compound applied to said bottom side of said lid, said ring of an organic sealing compound being adapted to engage the ring of the container in a continuous pattern.

21. In combination with a container having a product therein and having a helically threaded finish portion for receiving a closure to close said container, said finish portion terminating in a rim, said container further having an annular bead projecting radially outwardly from said container below said helically threaded finish portion, a closure comprising, in combination:

a lid having an outer annular portion, said outer annular portion having a top and a bottom, said lid spanning and engaging said rim of said finish portion of said container; and a lid retaining ring, said lid retaining ring comprising;

an annular skirt having an upper portion and a lower portion, said annular skirt surrounding said helically threaded finish portion on said container;

lid engaging means projecting radially inwardly from said annular skirt at a location adjacent said upper portion of said annular skirt, said lid engaging means engaging said top and said bottom of said outer annular portion of said lid to frictionally retain said lid and said lid retaining ring in position relative to one another, said lid engaging means comprising a circumferential series of spaced apart flanges engaging said top of said outer annular portion of said lid, and thread engaging means projecting radially inwardly from said annular skirt at a location between said upper portion and said lower portion, said thread engaging means engaging said helically threaded finish portion of said container for permitting said closure to be removed from said container by an unscrewing action.

22. A combination according to claim 21 wherein said lid retaining ring is molded in a single piece from a thermoplastic material.

23. A combination according to claim 22 wherein said thermoplastic material is a material whose primary ingredient is selected from the group consisting of high density polyethylene, polypropylene, modifications of polypropylene and flexible polyesters and copolyesters.

24. A combination closure according to claim 22 wherein said lid retaining ring is molded by a process selected from the group consisting of injection molding processes and compression molding processes.

25. A combination according to claim 21 wherein said lid retaining means further comprises a circumferential series of spaced apart flexible tabs, each of said flexible tabs extending inwardly and upwardly from said annular skirt and engaging said bottom of said outer annular portion of said lid.

26. A combination according to claim 25 wherein the flexible tabs in said circumferential series of spaced apart flexible tabs are offset with respect to the flanges in said circumferential series of spaced apart flanges.

27. A combination according to claim 21 wherein said lid comprises a disc that is formed from a metallic sheet, and wherein said outer annular portion of said lid comprises a curled edge of said disc.

28. A combination according to claim 27 wherein said disc has a top side and a bottom side and wherein said lid further comprises a ring of an organic sealing compound applied to said bottom side of said disc, said ring of an organic sealing compound sealingly engaging said rim of said finish portion of said container in a continuous pattern.

29. A combination according to claim 21 wherein said lid retaining ring of said closure further comprises tamper indicating means adjacent to said lower portion of said annular skirt, said tamper-indicating means comprising means engaging said annular bead of said container and being separable from said lower portion of said annular skirt upon the removal of said closure from said container to provide a visible indication of said removal of said closure from said container.

30. A combination according to claim 29 wherein said tamper indicating means further comprises annular band means positioned below said annular skirt and frangible bridge means connecting said annular band means to said annular skirt.

31. A combination according to claim 30 wherein said means engaging said finish of said container comprises flexible finish engaging means extending inwardly and upwardly from said annular band means.

32. A combination according to claim 31 wherein said closure has a longitudinal axis, wherein said flexible finish engaging tab means comprises a circumferential series of spaced apart flexible finish engaging tabs defining a circumferential series of spaces, each space in said circumferential series of spaces being positioned between a pair of adjacent flexible finish engaging tabs of said circumferential series of spaced apart flexible finish engaging tabs, and wherein said thread engaging means of said lid retaining ring comprises a circumferential series of spaced apart thread engaging elements defining a second circumferential series of spaces, each space in said second circumferential series of spaces being positioned between a pair of adjacent thread engaging elements in said circumferential series of thread engaging elements and being aligned with one of said flexible finish engaging tabs in said circumferential series of flexible finish engaging tabs along an axis that extends parallel to said longitudinal axis of said closure.

33. A combination according to claim 32 wherein each of said spaced apart thread engaging elements comprises a helical thread segment.

34. In combination with a container having a vacuum-packed product therein and having a helically threaded finish portion for receiving a closure to close and seal said container, said finish portion terminating in a rim, said container further having an annular bead projecting radially outwardly from said container below said helically threaded finish portion, a tamper indicating vacuum indicating closure comprising, in combination:

a lid being formed from a metal sheet and spanning and sealingly engaging said rim of said finish portion of said container, said lid comprising;

an outer annular portion with a top and a bottom, a generally centrally located vacuum indicating button, and an inner annular portion surrounding said vacuum indicating button and being surrounding by said outer annular portion, said vacuum indicating button being movable relative to said outer portion, under the influence of pressure conditions in said container, from a first position which indicates that sub-atmospheric pressure conditions do exist within said container; and a lid retaining ring, said lid retaining ring comprising;

an annular skirt having an upper portion and a lower portion, said annular skirt surrounding said helically threaded finish on said container;

lid engaging means projecting radially inwardly from said annular skirt at a location adjacent said upper portion of said annular skirt, said lid engaging means comprising a circumferential series of spaced apart flanges said top of said outer annular portion of said lid, said lid engaging means further engaging said bottom of said outer annular portion of said lid to frictionally retain said lid and said lid retaining ring in position relative to one another;

thread engaging means projecting radially inwardly from said annular skirt at location between said upper portion and said lower portion, said thread engaging means engaging said helically threaded finish portion of said container for permitting said closure to be removed from said container by an unscrewing action; and tamper indicating means adjacent said lower portion of said annular skirt, said tamper indicating means comprising means engaging said annular bead of said container and being separable from said lower portion of said annular skirt upon the removal of said closure from said container to provide a visible indication of said removal of said closure from said container.

35. A combination according to claim 34 wherein said lid retaining ring is molded in a single piece from a thermoplastic material.

36. A combination according to claim 35, wherein said thermoplastic material is a material whose primary ingredient is selected from the group consisting of high density polyethylene, polypropylene, modifications of polypropylene and flexible polyesters and copolyesters.

37. A combination closure according to claim 35 wherein said lid retaining ring is molded by a process selected from the group consisting of injection molding processes and compression molding processes.

38. A combination according to claim 35 wherein said tamper indicating means further comprises annular band means positioned below said annular skirt and frangible bridge means connecting said annular band means to said annular skirt.

39. A combination according to claim 38 wherein said means engaging said finish of said container comprises flexible finish engaging means extending inwardly and upwardly from said annular band means.

40. A combination according to claim 39 wherein said closure has a longitudinal axis, wherein said flexible finish engaging tab means comprises a circumferential series of spaced apart flexible finish engaging tabs defining a circumferential series of spaces, each space in said circumferential series of spaces being positioned between a pair of adjacent flexible finish engaging tabs of said circumferential series of spaced apart flexible finish engaging tabs, and wherein said thread engaging means of said lid retaining ring comprises a circumferential series of spaced apart thread engaging elements defining a second circumferential series of spaces, each space in said second circumferential series of spaces being positioned between a pair of adjacent thread engaging elements in said circumferential series of thread engaging elements and being aligned with one of said flexible finish engaging tabs in said circumferential series of flexible finish engaging tabs along an axis that extends parallel to said longitudinal axis of said closure.

41. A combination according to claim 40 wherein each of said spaced apart thread engaging elements comprises a helical thread segment.

42. A combination according to claim 34 wherein said lid retaining means further comprises a circumferential series of spaced apart flexible tabs, each of said flexible tabs extending inwardly and upwardly from said annular skirt and engaging said bottom of said outer annular portion of said lid.

43. A combination according to claim 42 wherein the flexible tabs in said circumferential series of flexible tabs are circumferentially offset with respect to the flanges in said circumferential series of spaced apart flanges.

44. A combination according to claim 43 wherein said outer annular portion of said lid comprises a curled edge of said metal sheet.

45. A combination according to claim 44 wherein said lid has a top side and a bottom side, and wherein said lid further comprises a ring of an organic sealing compound appled to said bottom side of said lid, said ring of an organic sealing compound sealingly engaging said rim of said finish portion of said container in a continuous pattern.

46. A tamper indicating closure for engaging the rim of a helically threaded finish on a container, said closure having a longitudinal axis and comprising, in combination:

a lid having an outer annular portion, said outer annular portion having a top and a bottom, said lid being adapted to span and engage the rim of the finish of the container; and a lid retaining ring, said lid retaining ring being molded in a single piece from a thermoplastic material and comprising;

an annular skirt having an upper portion and a lower portion, said annular skirt being adapted to surround the helically threaded finish on the container, lid engaging means projecting radially inwardly from said annular skirt at a location adjacent said upper portion of said annular skirt for engaging said top and said bottom of said outer annular portion of said lid to mechanically retain said lid and said lid retaining ring in position relative to one another, thread engaging means projecting radially inwardly from said annular skirt at a location between said upper portion and said lower portion for engaging the helically threaded finish of the container and for permitting said closure to be removed from the container by an unscrewing action, and tamper indicating means adjacent said lower portion of said annular skirt, said tamper indicating means comprising annular band means positioned below said annular skirt, frangible bridge means connecting said annular band means to said annular skirt, and flexible finish engaging tab means extending from said annular band means and being engageable with the finish of the container, said flexible finish engaging tab means comprising a circumferential series of spaced apart flexible finish engaging tabs, said circumferential series of spaced apart flexible finish engaging tabs defining a circumferential series of spaces, each space in said circumferential series of spaces being positioned between a pair of adjacent flexible finish engaging tabs of said circumferential series of spaced apart flexible finish engaging tabs, said thread engaging means of said lid retaining ring comprising a circumferential series of spaced apart thread engaging elements defining a second circumferential series of spaces, each space in said second circumferential series of spaces being positioned between a pair of adjacent thread engaging elements in said circumferential series of thread engaging elements and being aligned with one of said flexible finish engaging tabs in said circumferential series of flexible finish engaging tabs along an axis that extends parallel to said longitudinal axis of said closure, said annular band means being separable from said lower portion of said annular skirt upon the removal of said closure from the container to provide a visible indication of said removal of said closure from the container, said flexible finish engaging tab means comprising at least one flexible tab extending inwardly and upwardly from said annular band means and having an underside and notch means in said underside to permit said flexible tab to be deflected upwardly upon the application of said closure to the threaded finish of the container.

47. A tamper indicating closure according to claim 46 wherein each of said spaced apart thread engaging elements comprises a helical thread segment.

48. A tamper indicating, vacuum indicating closure for sealingly engaging the rim of a helically threaded finish on a container containing a vacuum-packed product, said closure having a longitudinal axis and comprising, in combination;

a lid, said lid being formed from a metal sheet and being adapted to span and sealingly engage the rim of the finish of the container, said lid comprising;

an outer annular portion with a top and a bottom, a generally centrally located vacuum indicating button, and an inner annular portion surrounding said vacuum indicating button and being surrounded by said outer annular portion, said vacuum indicating button being movable relative to said outer annular portion, under the influence of pressure conditions in the container, from a first position which indicates that subatmospheric pressure conditions do not exist within the container to a second position which indicates that subatmospheric pressure conditions do exist within the container; and a lid retaining ring, said lid retaining ring being molded in a single piece from a thermoplastic material and comprising;

an annular skirt having an upper portion and a lower portion, said annular skirt being adapted to surround the helically threaded finish on the container, lid engaging means projecting radially inwardly from said annular skirt at a location adjacent said upper portion of said outer annular skirt for engaging said top and said bottom of said outer annular portion of said lid to mechanically retain said lid and said lid retaining ring in position relative to one another, thread engaging means projecting radially inwardly from said annular skirt at a location between said upper portion and said lower portion for engaging the helically threaded finish of the container and for permitting said closure to be removed from the container by an unscrewing action, and tamper indicating means adjacent said lower portion of said annular skirt, said tamper indicating means comprising annular band means positioned below said annular skirt, frangible bridge means connecting said annular band means to said annular skirt, and flexible finish engaging tab means extending radially inwardly and upwardly from said annular band means and being engageable with the finish of the container and being separable from said lower portion of said annular skirt upon the removal of said closure from the container to provide a visible indication of said removal of said closure from the container, said flexible finish engaging tab means comprising a circumferential series of spaced apart flexible finish engaging tabs defining a circumferential series of spaces, each space in said circumferential series of spaces being positioned between a pair of adjacent flexible finish engaging tabs of said circumferential series of spaced apart flexible finish engaging tabs, said thread engaging means of said lid retaining ring comprising a circumferential series of spaced apart thread engaging elements defining a second circumferential series of spaces, each space in said second circumferential series of spaces being positioned between a pair of adjacent thread engaging elements of said circumferential series of thread engaging elements and being aligned with one of said flexible finish engaging tabs in said circumferential series of flexible finish engaging tabs along an axis that extends parallel to said longitudinal axis of said closure.

49. A tamper indicating, vacuum indicating closure according to claim 48 wherein each of said spaced apart thread engaging comprises a helical thread segment.

* * * * *